US005758794A

United States Patent [19]

Rider, Jr. et al.

[11] Patent Number: 5,758,794

[45] Date of Patent: Jun. 2, 1998

[54] TABLESS CONTAINER CLOSURE

[75] Inventors: Edward W. Rider, Jr., Slate Hill; Alex Augustin, Aparrowbush, both of N.Y.

[73] Assignee: Genpak Corporation, Glens Falls, N.Y.

[21] Appl. No.: 649,314

[22] Filed: May 17, 1996

[51] Int. Cl.[6] ..... B65D 43/02

[52] U.S. Cl. ..... 220/523; 220/786; 220/793

[58] Field of Search ..... 206/541, 545, 206/557; 220/4.21–4.23, 23.83, 23.86, 523, 524, 526, 555, 556, 783, 792; 426/107, 119, 120, 124

[56] References Cited

U.S. PATENT DOCUMENTS

| | | | |
|---|---|---|---|
| 532,361 | 1/1895 | Carabine . | |
| 1,714,772 | 4/1929 | Gabriel . | |
| 1,770,807 | 7/1930 | Rollason . | |
| 2,794,664 | 6/1957 | Kruger | 292/129 |
| 3,458,113 | 7/1969 | Swartzbaugh | 229/44 |
| 3,645,758 | 2/1972 | MacManus | 99/172 |
| 3,767,110 | 10/1973 | Congleton | 229/45 |
| 3,786,982 | 1/1974 | Rakes et al. | 229/2.5 |
| 3,935,962 | 2/1976 | Schubert et al. | 220/786 |
| 3,984,027 | 10/1976 | Smith | 220/786 |
| 4,020,946 | 5/1977 | Gardner et al. | 206/45.16 |
| 4,061,241 | 12/1977 | Retelny | 220/786 |
| 4,081,646 | 3/1978 | Goltsos | 426/107 |
| 4,494,650 | 1/1985 | Cullen | 220/788 |
| 4,555,043 | 11/1985 | Bernhardt | 220/790 |
| 4,592,468 | 6/1986 | Wallace | 206/387 |
| 4,915,251 | 4/1990 | Payne | 220/4.23 |
| 5,031,768 | 7/1991 | Fischer | 206/370 |
| 5,048,707 | 9/1991 | Hallberg | 220/788 |
| 5,092,479 | 3/1992 | Wells | 220/4.23 |
| 5,131,551 | 7/1992 | Wells | 220/4.23 |
| 5,377,860 | 1/1995 | Littlejohn et al. | 220/790 |
| 5,538,154 | 7/1996 | Von Holdt | 220/784 |

*Primary Examiner*—Jimmy G. Foster
*Attorney, Agent, or Firm*—Heslin & Rothenberg,P.C.; Wayne F. Reinke, Esq.

[57] ABSTRACT

A container closure for a container with a cover and a base. The cover includes a sidewall and a rim coupled to the sidewall. The rim includes a depression that takes the place of a male closure component. The base includes a sidewall and an opening in the sidewall for receiving the rim depression. The rim depression and receiving opening provide a snap-fit closure to releasably connect the cover and base.

17 Claims, 5 Drawing Sheets

FIG. 8
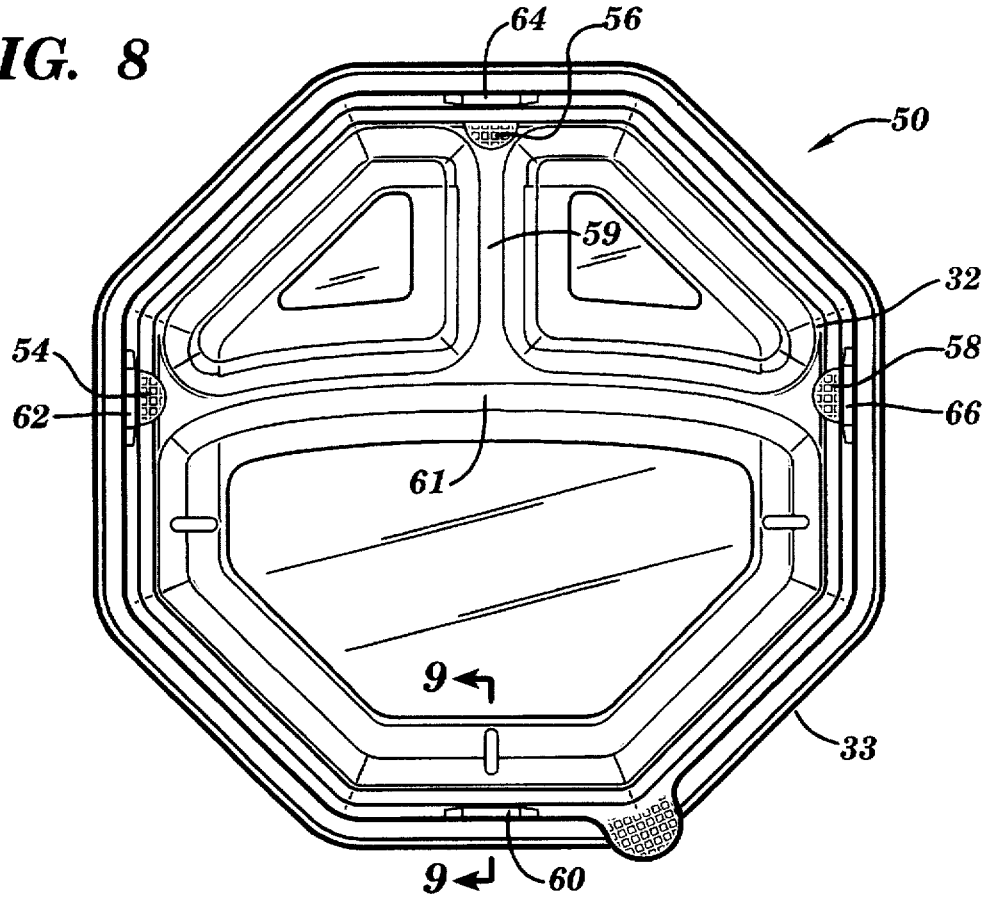
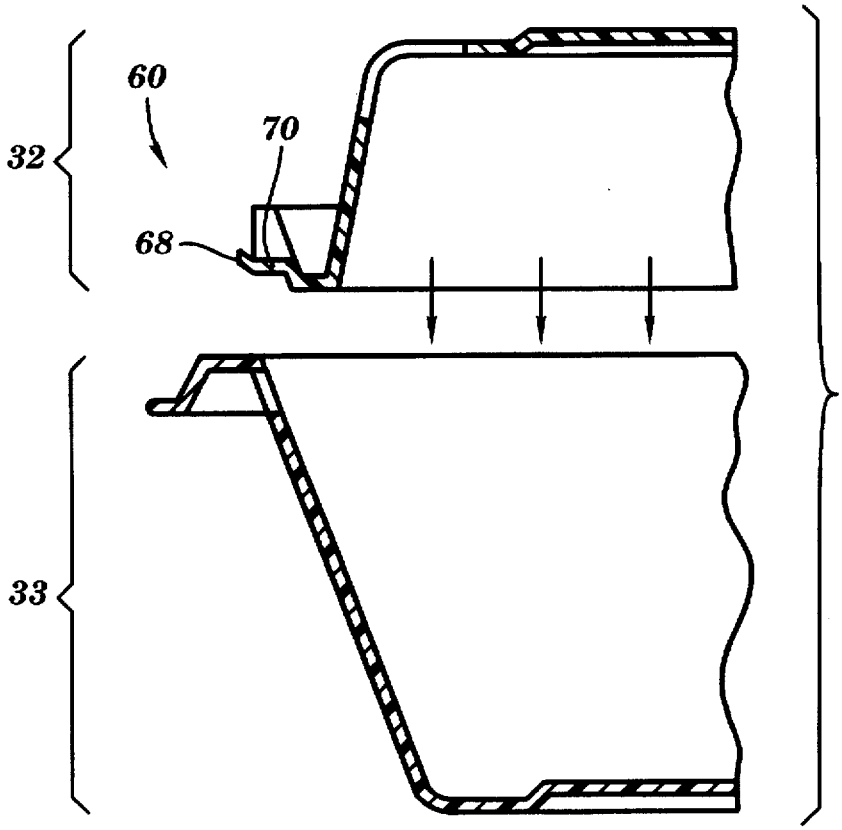
FIG. 9

TABLESS CONTAINER CLOSURE

BACKGROUND OF THE INVENTION

This application contains subject matter which is related to the subject matter of the following applications which are assigned to the same assignee as this application, and which are being filed concurrently herewith:

"Food Dish," by Rider, Jr. et al., Ser. No. 29/054,616 (Attorney Docket No. 0869.009), filed May 17,1996, U.S. Pat. No. Des. 380,648;

"Compartmentalized Container," by Rider, Jr., Ser. No. 08/650,013 (Attorney Docket No. 0869.017), filed May 17, 1996, pending; and "Compartmentalized Container," by Rider, Jr. et al., Ser. No. 08/649,294 (Attorney Docket No. 0869.018), filed May 17, 1996, abandoned.

TECHNICAL FIELD

The present invention generally relates to container closures. More particularly, the present invention relates to containers having male/female closures.

BACKGROUND INFORMATION

In the past, container closures with a male component and a female component have included male components comprised of a tab or extension straight out from the wall of the container top. Many food containers, such as, for example, fast food containers, include such a closure. This type of container closure can be cumbersome, since the tab and/or container must be deformed enough to allow the tab to clear the female component before entry thereinto. In addition, this excess deformation could damage the container.

Thus, a need exists for a container closure that reduces the amount of deformation and effort needed to close the container.

SUMMARY OF THE INVENTION

Briefly, the present invention satisfies the need for a container closure that reduces container deformation and effort to close by replacing the male component with an indentation in a peripheral rim that provides a snap fit with the female closure component.

In accordance with the above, it is an object of the present invention to provide a container closure that reduces the need to deform the container as compared to a male/female container closure with a tab or extension out from a sidewall as the male component.

It is a further object of the present invention to provide a container that is relatively easy to close.

The present invention provides, in a first aspect, a container comprising a base and a cover for covering the base. One of the portions includes a sidewall having an outwardly extending rim coupled thereto at a periphery thereof. The outwardly extending rim includes an indentation, and the other portion includes a sidewall having an opening therein for receiving the indentation. The cover and base are releasably connected when the opening receives the indentation. Where the cover includes the outwardly extending rim, it may further include a channel connecting the sidewall and rim. Where the channel is present, the base of the container may include a rim extending outward from the sidewall at a periphery thereof, a non-indentation portion of the cover rim resting above the bottom rim when the opening receives the indentation. The container portion that includes the indentation may further include a lifting extension and/or be made of plastic. Where the container with the indentation portion is plastic, the base may be made of foam. The cover and bases of the container may be hingedly connected, and, if so, the container may be a unitary structure. The base of the container may include a plurality of compartments, and, if so, the base may be a unitary structure and/or the cover may comprise a plurality of compartments corresponding to those in the base.

The present invention provides, in a second aspect, a container closure, the container closure being part of a container including a base and a cover for covering the base. One of the container portions includes a sidewall with a rim coupled to and extending out therefrom. The container closure comprises an indentation in the rim, the indentation acting as a male closure component, and a female closure component in the other container portion for receiving the indentation. The female closure component may take the form of a sidewall of the other container portion having an opening therein for receiving the indentation. Where the indentation is included in the cover, it may take the form of a depression of the rim.

These, and other objects, features and advantages of this invention will become apparent from the following detailed description of the various aspects of the invention taken in conjunction with the accompanying drawings.

BRIEF DESCRIPTION OF THE DRAWINGS

FIG. 8 is a top view of the container of FIG. 7.

FIG. 9 is a cross-sectional view of a closure portion of the container of FIG. 7.

BEST MODE FOR CARRYING OUT THE INVENTION

Figure 1:
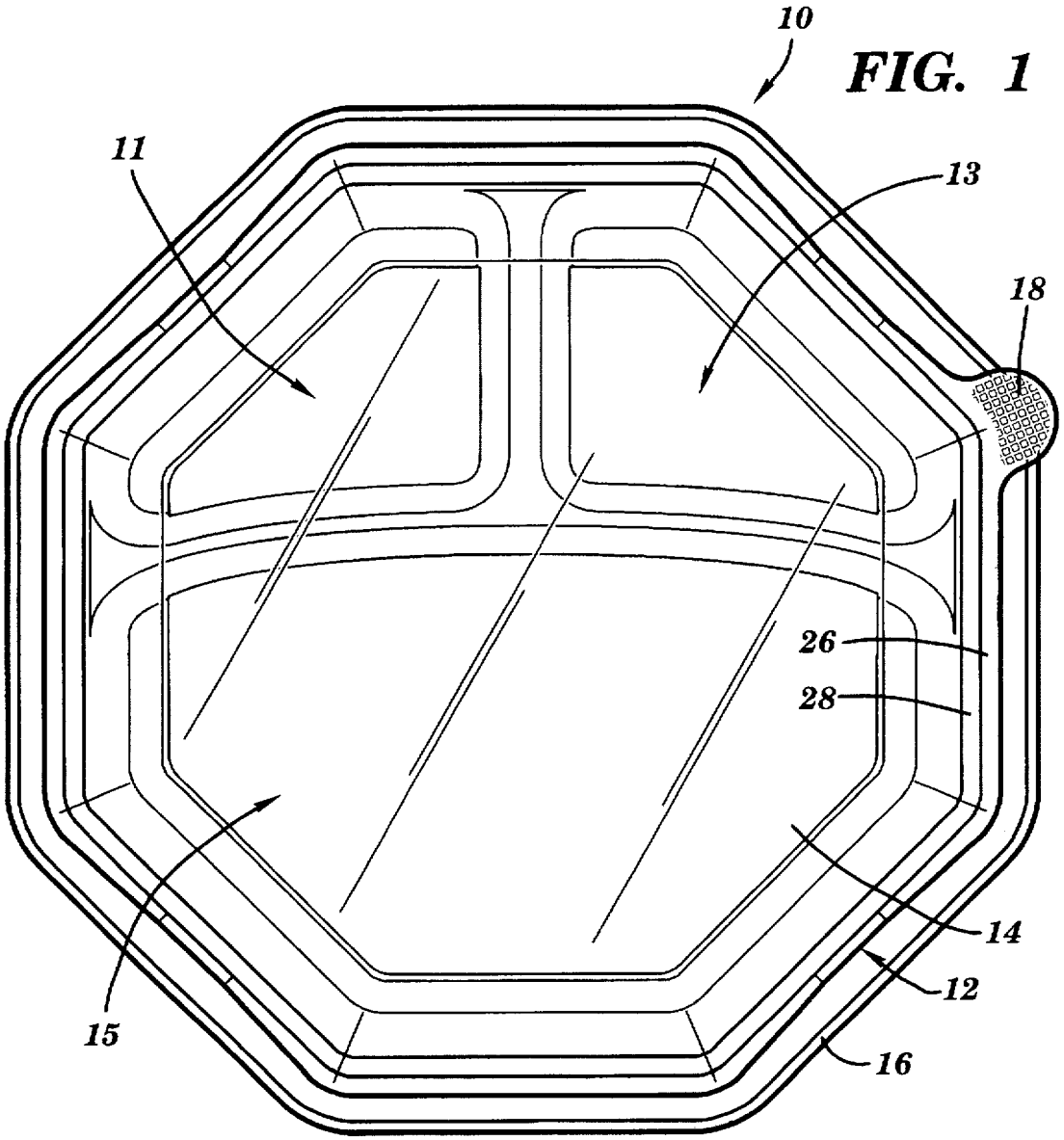
FIG. 1 is a top view of a container with closures according to the present invention.
Figure 2:
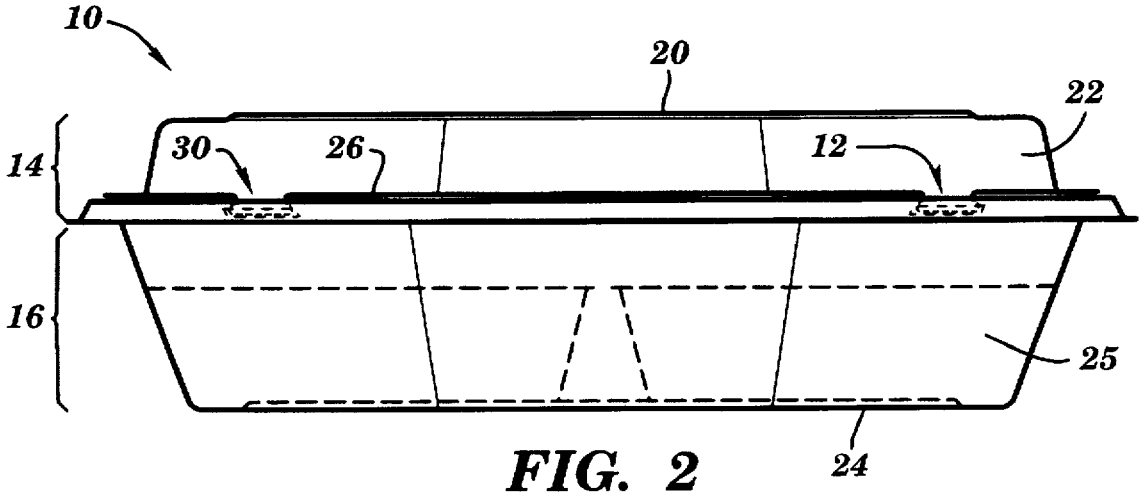
FIG. 2 is a side view of the container of FIG. 1.

FIGS. 1 and 2 depict an exemplary food container 10 embodying the present inventive container closure, e.g., container closure 12, shown in more detail in subsequent figures. Container 10 includes cover 14 and base 16. Although shown as two separate pieces, cover 14 and base 16 could be hingedly connected, and there could be fewer or a greater number of container closures. Cover 14 comprises lifting extension 18, which is a protrusion therefrom with a roughened surface to assist in separating cover 14 from base 16. Cover 14 comprises a top 20 with sidewalls depending therefrom, e.g., sidewall 22. Base 16 comprises a floor 24 and sidewalls extending upward therefrom, e.g., sidewall 25. As shown in FIG. 1, top portion 14 is made of a transparent plastic, showing compartments 11, 13 and 15 of base 16. However, it need not be transparent or plastic.

Figure 3:
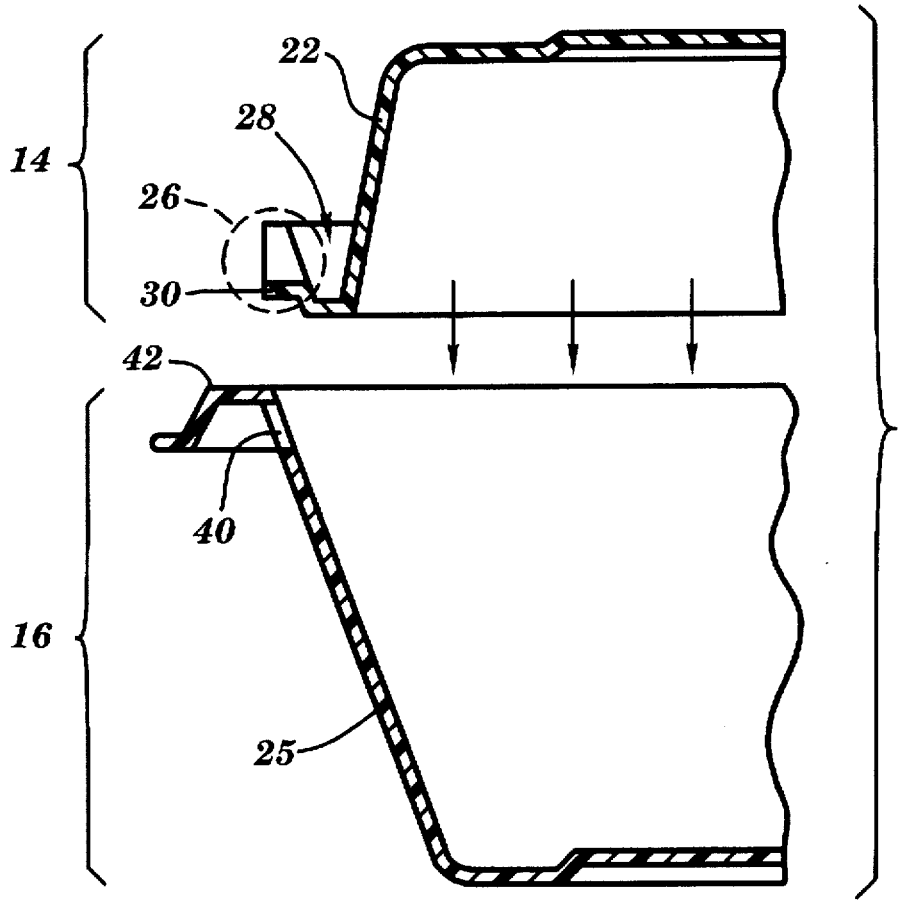
FIG. 3 is a cross-sectional view of a closure portion of the container of FIG. 1 with the container opened.

FIG. 3 is a cross-sectional view showing the components of closure 12 with cover 14 and base 16 separated. Cover 14 also comprises outwardly extending rim 26 around the periphery thereof. Between the sidewalls and outwardly extending rim 26 is channel 28. Rim 26 comprises several indentations therein, e.g., indentation 30, taking the form of a depression of rim 26. Although four such indentations are present in container 10, it will be understood that there could be a greater number or as few as one. In addition, it will also be understood that an indentation of the present invention could also take the form of a raised portion of the rim, and can be different shapes than generally rectangular, as shown best in FIG. 5. Although not required, channel 28 makes it easier to depress rim 26 in particular areas to create the indentations, by creating a gap between the sidewall and rim.

As shown in FIG. 1, lifting extension 18 may take the form of an extension of rim 26. However, the lifting extension could take any form that would assist in separating the cover from the base. Preferably, the lifting extension is included in the container portion that includes the indentations, however, that need not be the case, and there could alternatively be lifting extensions on both container portions laterally displaced from one another. As compared to known male/female container closures, which include tabs or extensions as the male component, the indentation of the present inventive container closure replaces such male components, allowing less deformation of cover 14 before closure is achieved.

Figure 7:
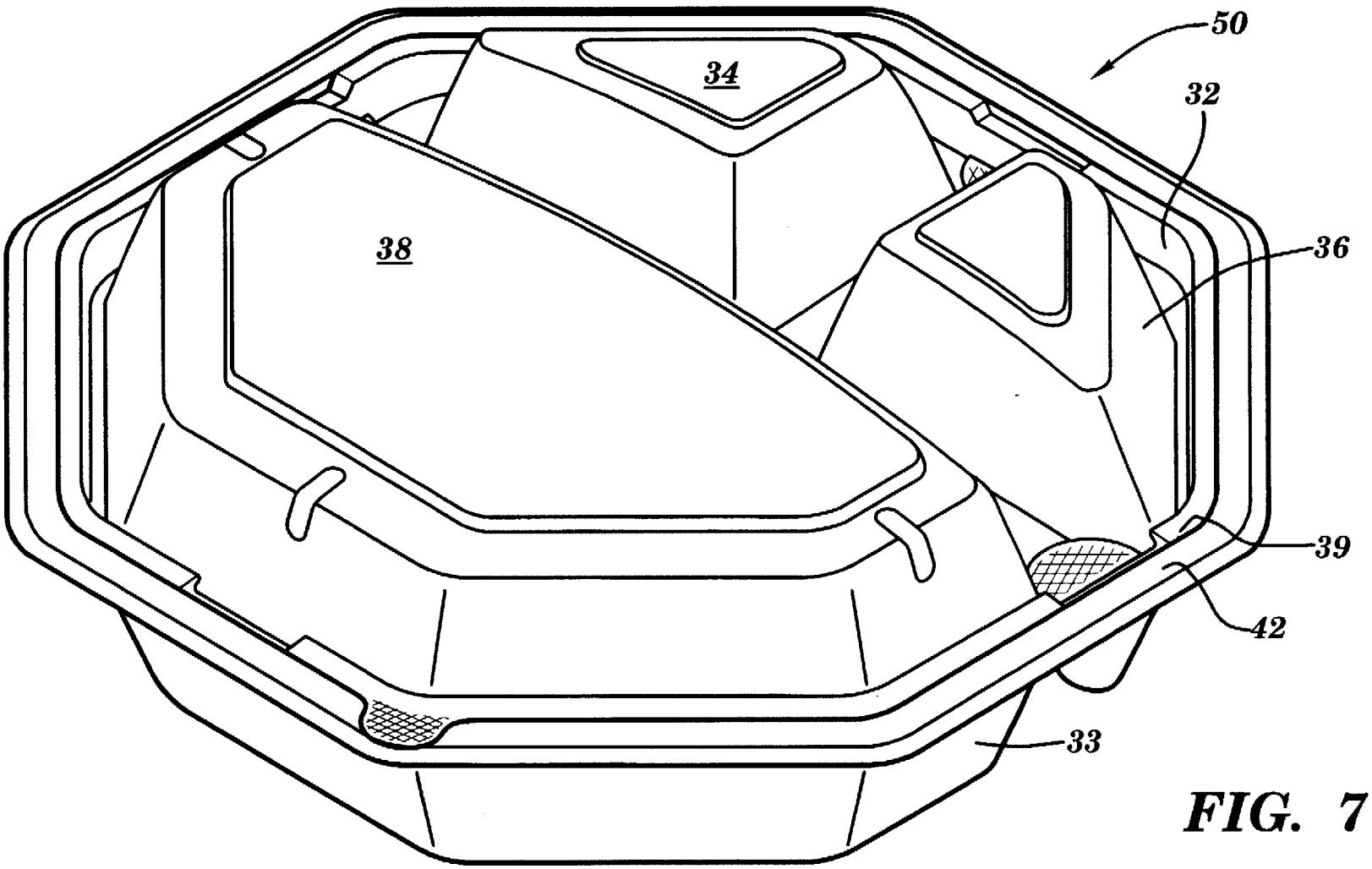
FIG. 7 is a perspective view of another container according to the present invention.

FIG. 7 is a perspective view of an exemplary alternative container 50 according to the present invention. Container 50 includes cover 32 and base 33. Cover 32 is shown opaque in FIG. 7 for clarity. Base 33 is identical to base 16, except for the placement of the female closure components. As shown, cover 32 has three compartments 34, 36 and 38 corresponding to the compartments in base 33 (see FIG. 8). In this way, the food in the different compartments is segregated to help prevent unwanted intermixing. Although shown in other figures, FIG. 7 best shows that the cover rim (herein, rim 39) rests on the base rim 42 when the container cover and base are releasably connected.

Referring again to FIG. 1, base 16 may be compartmentalized, depending on the particular use being given. Base 16 is shown in FIG. 1 with three compartments (11, 13 and 15), however, it will be understood that there could be a greater or lesser number, depending on the intended use. For example, if container 10 is to be used to store food, the different compartments could hold and keep separate different food portions comprising the different courses of a meal. In addition, if the base is compartmentalized, it is preferably a unitary structure. Although base 16 could be comprised of any suitable material, for example, plastic, it is preferably thermoformed from a rigid foam. As used herein, the term "rigid foam" refers to any foam material suitable for forming containers of the type described herein, such as, for example, polystyrene foam. Also, where cover 14 and base 16 are hingedly connected, container 10 could itself be a unitary structure. Base 16 also comprises several female closure components, e.g., female closure component 40 shown in FIG. 3, corresponding to the indentations of cover 14.

Figure 5:
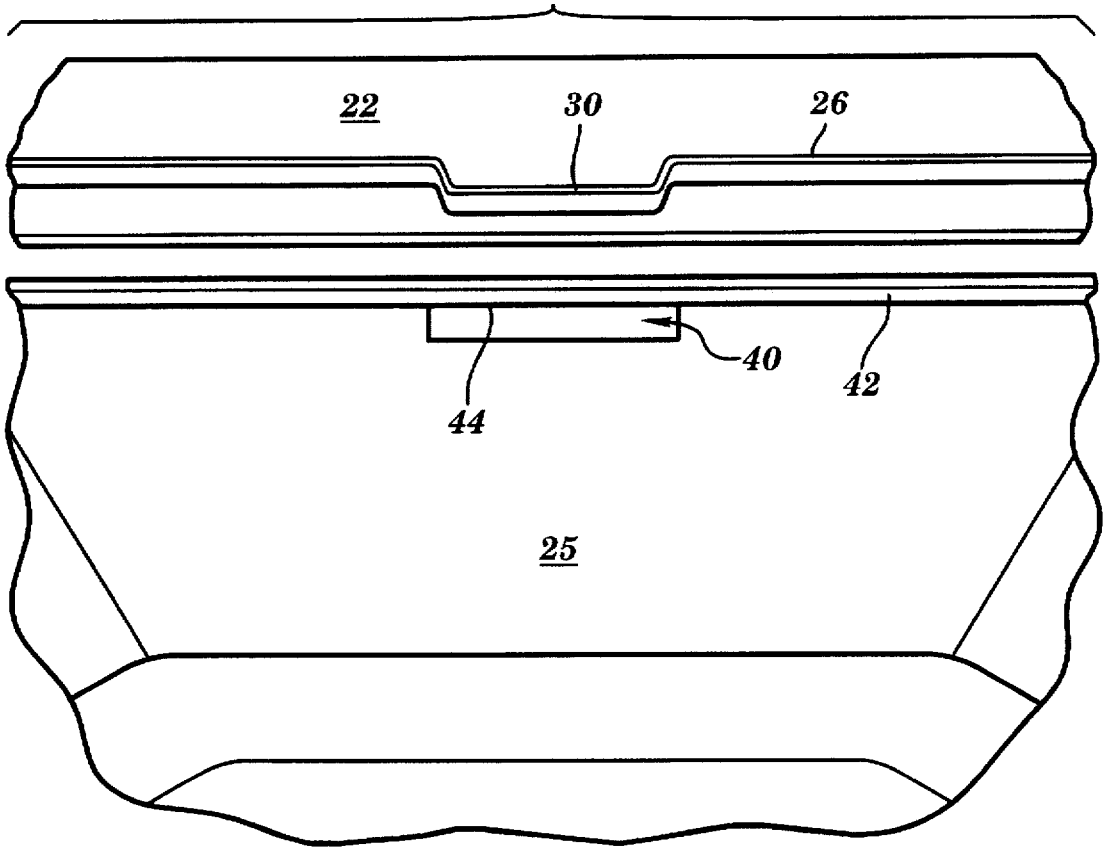
FIG. 5 is an angled view of the closure of FIG. 3 from below the container.

As shown in FIG. 5, the female closure components take the form of generally rectangular openings in the sidewalls, where the sidewalls meet rim 42. If the material used for the base is more easily deformable than the cover, for example, recyclable plastic for the cover and rigid foam for the base, then the indentations may slightly cut into the top edges, e.g., edge 44, of the openings. Such slight deformations may actually improve conformity of the openings to the indentations. If the base is not made of a more deformable material than the cover, for example, if both portions were made of recyclable plastic, then the openings could be initially shaped to more accurately conform to the indentations, rather than relying on the indentations to mold the openings to their shape.

Figure 4:
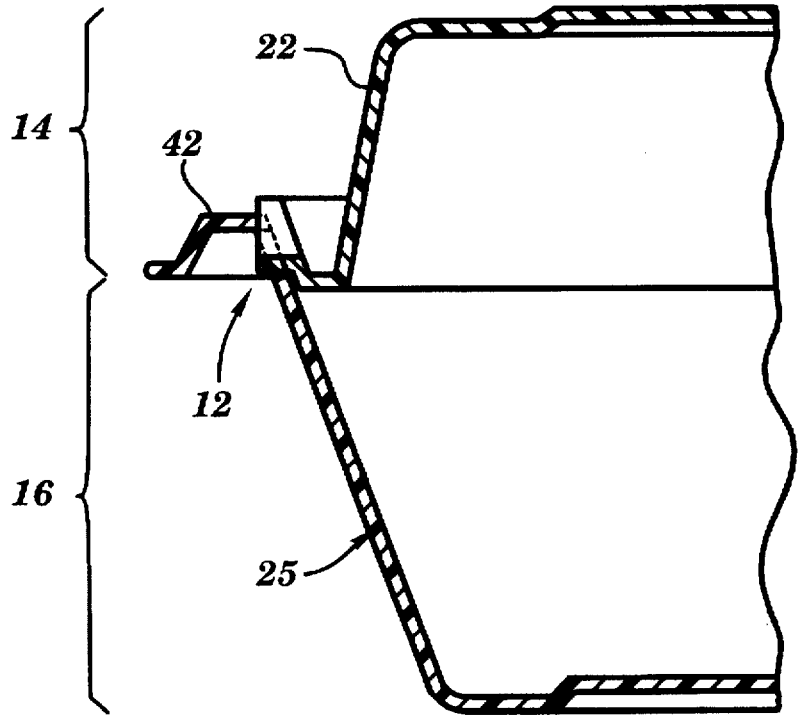
FIG. 4 depicts the closure portion of FIG. 3 with the container closed.
Figure 6:
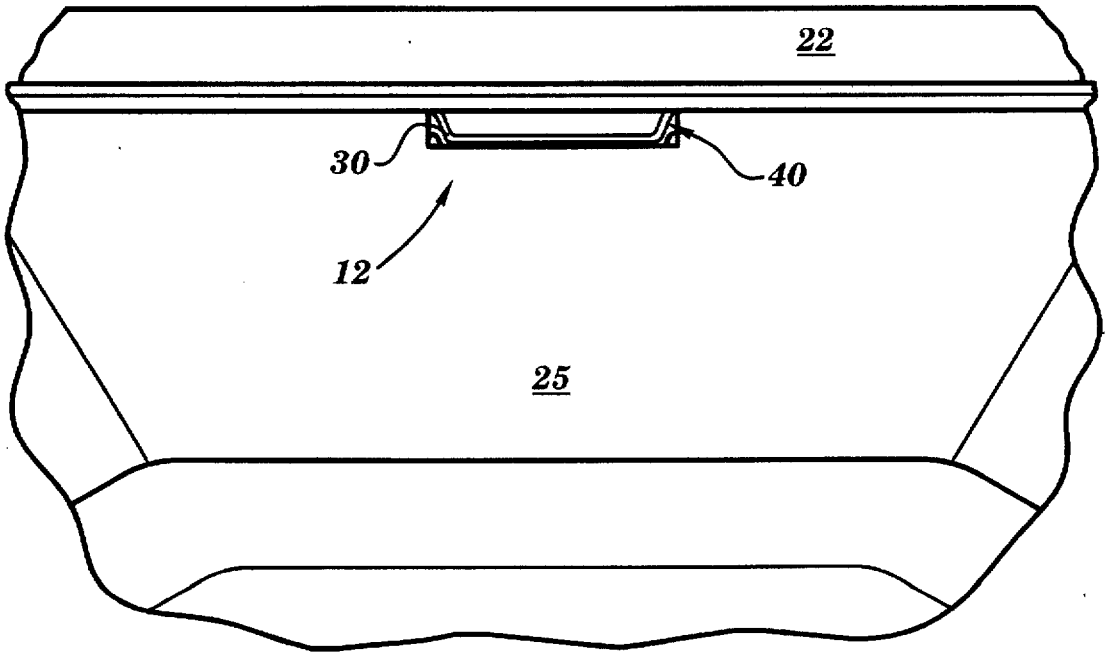
FIG. 6 is an angled view of the closure of FIG. 4 from below the container.

FIGS. 4 and 6 depict cover 14 releasably connected to base 16. A releasable connection is made, for example, when indentation 30 is received by female closure component 40. With respect to container 10, cover 14 is pushed down onto base 16 until a "snap fit" is made between the indentations and their corresponding openings. While the cover is being pushed onto the base for closure, the sidewalls of the cover near the indentations, e.g., sidewall 22, deform slightly, until the indentations are received by the openings. By simply placing the cover over the bottom such that the indentations line up with the openings, and pushing down on the cover, closure of the container is accomplished with minimal effort.

FIG. 8 is a top view of container 50 of FIG. 7, except that cover 32 is clear, rather an opaque. The compartmentalized plastic cover 32 includes raised areas 54, 56 and 58 directly above compartment dividers 59 and 61. The raised areas each have a roughened surface similar to that of extension 18 of container 10 of FIG. 1. Raised areas 54, 56 and 58 are used to push cover 32 down onto base 33 such that closures 60, 62, 64 and 66, which are an alternate version of closure 12 in FIG. 1, close properly. Since cover 32 is somewhat flexible, the compartmentalized nature makes closing cover 32 by pressing down in the center (as with cover 14 in FIG. 1) difficult. However, if cover 32 were stiff instead of flexible, raised areas 54, 56 and 58 would not be needed.

FIG. 9 is a cross-sectional view of container 50 showing details of closure 60, which is exemplary of the other closures. Closure 60 is similar to closure 12 in FIG. 3, except that closure 60 includes an angled extension 68 out from depressed rim area 70. Extension 68 is only about ¼ the width of depressed rim area 70, and is angled upward to both encourage closure and discourage unwanted or accidental removal of cover 32 from base 33.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

We claim:

1. A container, comprising:

a base; and a cover for covering the base, one of the cover and the base including a first sidewall having an outwardly extending rim coupled thereto at a periphery thereof, the outwardly extending rim including a vertical indentation therein having an outwardly extending projection and the other of the cover and the base including a second sidewall having an opening therein for receiving the outwardly extending projection of the vertical indentation, wherein the cover and the base are releasably connected when the opening receives the outwardly extending projection of the vertical indentation.

2. The container of claim 1, wherein the cover comprises the outwardly extending rim, and wherein the vertical indentation takes the form of a depression of the outwardly extending rim.

3. The container of claim 2 wherein the cover further comprises a channel connecting the first sidewall and the outwardly extending rim.

4. The container of claim 3, wherein the base further includes a rim extending outward from the second sidewall at a periphery thereof, and wherein a non-indentation portion of the outwardly extending rim of the cover rests above the rim of the base when the opening receives the outwardly extending projection of the vertical indentation.

5. The container of claim 2, wherein the outwardly extending projection comprises an angled extension.

6. The container of claim 1 wherein the one of the cover and the base further includes a lifting extension.

7. The container of claim 1 wherein the one of the cover and the base is made of plastic.

8. The container of claim 7 wherein the other of the cover and the base is made of rigid foam.

9. The container of claim 1 wherein the base and the cover are hingedly connected.

10. The container of claim 9 wherein the base and the cover comprise a unitary structure.

11. The container of claim 1 wherein the base comprises a plurality of compartments.

12. The container of claim 11 wherein the base comprises a unitary structure.

13. The container of claim 11 wherein the cover also comprises a plurality of compartments corresponding to the plurality of compartments in the base.

14. The container of claim 12, wherein the cover includes a plurality of raised areas for pressing down the cover, each raised area having a roughened surface.

15. A container closure, the container closure being part of a container including a base and a cover for covering the base, one of the base and the cover including a sidewall with a rim coupled to and extending out therefrom, the container closure comprising:

a vertical indentation in the rim, the vertical indentation acting as a male closure component, the vertical indentation having an outwardly extending projection; and a female closure component in the other of the base and the cover for receiving the outwardly extending projection, and wherein when the female closure component receives the outwardly extending projection, the cover and base are releasably connected.

16. The container closure of claim 15, wherein the female closure component comprises a sidewall of the other of the base and the cover having an opening therein for receiving the outwardly extending projection of the vertical indentation.

17. The container closure of claim 15, wherein the vertical indentation is included in the cover and takes the form of a depression of the rim.

* * * * * .

UNITED STATES PATENT AND TRADEMARK OFFICE

CERTIFICATE OF CORRECTION

PATENT NO. : 5,758,794

DATED : June 2, 1998

INVENTOR(S) : Rider, Jr. et al.

It is certified that error appears in the above-identified patent and that said Letters Patent is hereby corrected as shown below:

Title page, item

[75] Inventors: "Alex Augustin, Aparrowbush," should read --Alex Augustin, Sparrowbush,--

Signed and Sealed this

Twenty-ninth Day of September, 1998

*Attest:*

*Attesting Officer*

BRUCE LEHMAN

*Commissioner of Patents and Trademarks*